United States Patent [19]

Sakaguchi

[11] Patent Number: 4,860,639

[45] Date of Patent: Aug. 29, 1989

[54] FLEXIBLE TUBULAR WALL ACTUATOR WITH END-MOUNTED STRAIN GAUGE

[75] Inventor: Yuji Sakaguchi, Kodaira, Japan

[73] Assignee: Bridgestone Corporation, Tokyo, Japan

[21] Appl. No.: 180,724

[22] Filed: Apr. 4, 1988

Related U.S. Application Data

[63] Continuation of Ser. No. 804,959, Dec. 5, 1985, abandoned.

[30] Foreign Application Priority Data

| | | | |
|---|---|---|---|
| Dec. 11, 1984 | [JP] | Japan | 59-259896 |
| Dec. 28, 1984 | [JP] | Japan | 59-279771 |
| Dec. 28, 1984 | [JP] | Japan | 59-279773 |

[51] Int. Cl.[4] ..... F15B 15/02; F01B 31/12

[52] U.S. Cl. ..... 92/5 R; 92/92

[58] Field of Search ..... 92/89–92, 92/5 R, 253

[56] References Cited

U.S. PATENT DOCUMENTS

| | | | |
|---|---|---|---|
| 3,160,836 | 12/1964 | Farley | 92/5 R X |
| 3,611,881 | 10/1971 | Little | 92/255 |
| 4,058,178 | 11/1977 | Shinohara et al. | 92/5 R X |
| 4,294,163 | 10/1981 | Boehringer | 92/255 X |
| 4,615,420 | 10/1986 | Takagi et al. | 92/92 |

FOREIGN PATENT DOCUMENTS

| | | | |
|---|---|---|---|
| 924432 | 4/1982 | U.S.S.R. | 92/5 R |

OTHER PUBLICATIONS

Baumeister, T. et al., *Marks' Standard Handbook for Mechanical Engineers,* New York, N.Y.: McGraw Hill Co. 1979, pp. 5-52-5-53.

Holman, J. P., *Experimental Methods for Engineers,* New York, N.Y.: McGraw Hill Book Co. 1978, pp. 357–358.

Perry. C. C. et al., *The Strain Gage Primer,* McGraw Hill Book Co., New York, N.Y., 1962, p. 249.

*Primary Examiner*—Robert E. Garrett

*Assistant Examiner*—George Kapsalas

*Attorney, Agent, or Firm*—Sughrue, Mion, Zinn, Macpeak & Seas

[57] ABSTRACT

A pneumatic actuator includes a tubular body made of a rubber-like elastic material and a braided structure made of organic or inorganic high-tensile-strength fibers reinforcing an outside of the tubular body. Closure members sealingly close ends of the tubular body; at least one of the closure members has a fluid connecting passage. The tubular body deforms to expand its diameter when pressurized fluid is introduced through the connecting passage to cause contractive force in the longitudinal direction. Contraction-detecting strain gauges at one closure member provide signals corresponding to the contractive force of the actuator.

3 Claims, 12 Drawing Sheets

FLEXIBLE TUBULAR WALL ACTUATOR WITH END-MOUNTED STRAIN GAUGE

This is a continuation of Ser. No. 06/804,959, filed on Dec. 5, 1985 now abandon.

BACKGROUND OF THE INVENTION

This invention relates to a pneumatic actuator adapted to expand its diameter to cause a contraction force in axial directions by introducing a pressurized fluid thereinto. In particular, it relates to a pneumatic actuator capable of detecting relative movements between ends of the pneumatic actuator to control their positions when the pneumatic actuator is contracted.

Such a pneumatic actuator adapted to contract in axial directions while expanding in the radial direction by application of a pressurized fluid has a lot of advantages in that it is very light weight and easy to control owing to its smooth movement in comparison with actuators using electric motors or hydraulic cylinders. For example, a pneumatic actuator as shown in FIG. 1 has been known from Japanese Patent Application No. 40,378/77. The pneumatic actuator shown in FIG. 1 comprises a tubular body 1, a reinforcing braided structure 2 arranged externally thereon, closure members 3 at both ends and clamp sleeves 4.

The tubular body 1 is preferably made of a rubber or rubber-like elastomer which is air-impermeable and flexible. However, other materials equivalent thereto, for example, various kinds of plastics may be used for this purpose.

The reinforcing braided structure 2 is made of cords whose braided angles are approximate to what is called an angle of repose (54°44') when the tubular body 1 is expanded at the maximum with the pressurized fluid supplied thereinto. The cords are organic or inorganic high tensile strength fibers, preferably, for example, twisted or nontwisted filament bundles of aromatic polyamide fibers (trade name, KEVLAR) or very fine metal wires.

One of the closure members 3 is formed at least on one side with a connecting aperture 8 communicating with an inner cavity 7 of the tubular body 1 through an aperture 6 formed in the nipple 5 in its axial direction. A fitting 9 is fitted in the connecting aperture 11 of the closure member 3. To the fitting 9 is connected an operating pressure source, for example, an air compressor (not shown) by a line including a flow control valve. With this arrangement, when a controlled pressure is applied into the inner cavity 7 of the tubular body 1, the braided angles of the reinforcing structure 2 are enlarged to cause "pantagraph movement" of the reinforcing cords of the braided structure 2, so that the diameter of the tubular body 1 is expanded and the axial length thereof is contracted resulting therefrom to shorten a distance between pin apertures of the closure members 3.

With such a pneumatic actuator adapted to displace in its axial direction with the controlled pressure applied thereinto, however, the tubular body made of a rubber or rubber-like elastic material and the braided structure exhibit so-called "hysteresis error" when they expand or contract. As the result, their contracted lengths are different when the pressurized fluid is being supplied into and exhausted from the inner cavity of the tubular body. In order to determine their contracted lengths exactly, therefore, it is required to adjust the pressure of the pressurized fluid taking account of the hysteresis characteristics of the tubular body and the braided structure. It may unavoidably lower its operating efficiency.

With the pneumatic actuator above described, moreover, its contractive force cannot be directly determined, and due to the hysteresis characteristics it is required to calibrate the relation between the pressurized fluid to be applied and the contractive force. If the pneumatic actuator is used in a driving means which is required to know the contractive force caused by the pneumatic actuator exactly, detecting means is additionally needed for detecting the contractive force. Accordingly, the merit of the air bag type pneumatic actuator which is of light weight and inexpensive is spoiled and the space to be occupied by the pneumatic actuator increases.

In the above pneumatic actuator, moreover, pressure detecting means for detecting the pressure in the pneumatic actuator is provided in a line between the pneumatic actuator and an operating pressure source. Accordingly, there are various problems such as leakage of the pressurized fluid in the pressure detecting means and the line and limitation of location where the pneumatic actuator is arranged. Moreover, an operator does not known the pressure of the pressurized fluid serving to expand the actuator because the pressure cannot be directly detected.

SUMMARY OF THE INVENTION

It is a principal object of the invention to provide an improved pneumatic actuator which eliminates all the disadvantages of the prior art without losing the merits of the air-bag type pneumatic actuator.

In order to achieve this object, in a pneumatic actuator including a tubular body made of a rubber-like elastic material, a braided structure made of an organic or inorganic high tensile strength fibers reinforcing an outside of said tubular body and closure members sealingly closing ends of said tubular body, at least one of said closure members having a connecting passage, said tubular body being deformed to expand its diameter by introducing pressurized fluid thereinto through said connecting passage to cause contractive force in its longitudinal directions, according to the invention the actuator comprises an insertion member supported by one of said closure members and extending in an inner cavity of said tubular body, a receiving cylinder supported by the other of said closure members to telescopically receiving said insertion member and having displacement detecting means for detecting displacement of said insertion member, and displacement output means for generating output signals representative of relative movement between said closure members in response to detected signals from said detecting means.

With this pneumatic actuator according to the invention, when the pressurized air is supplied into the inner cavity of the tubular body, the actuator deforms to expand its diameter and axially contracts, whereby closure members sealingly closing both ends of the tubular body are moved toward each other. As the result, the insertion member mounted on one closure member enters further the receiving cylinder mounted on the other closure member. On the other hand, in order to detect the entered distance of the insertion member or relative displacement between the insertion member and the receiving cylinder, detecting means is provided in the receiving cylinder for outputting detected signals proportional to the relative displacement. The output signals are transmitted to output means for outputting the relative displacement between both the closure members. Accordingly, the hysteresis errors of the tubular body and the reinforcing braided structure need not be considered when the pressurized fluid is supplied to or exhaust from the tubular body.

The displacement detecting means is preferably optical detecting means cooperating with the insertion member. In this case, the insertion member is formed with slit-like patterns arranged in its moving direction with an interval and the optical detecting means comprises a light emission element, a detecting element including at its upper and lower portions slits whose phases are 90° shifted from each other and in opposition to the insertion member, and a light receiving element for receiving light which emitted from the light emission element and passed through the detecting element.

The displacement detecting means may be electrical detecting means cooperating with the insertion member. In this case, the insertion member is made of a magnetic material and the electrical detecting means comprises a coil arranged spaced apart and around the insertion member in the receiving cylinder consisting of a primary coil and secondary coils to form with the insertion member a differential transformer to produce detected signals corresponding to the displacement of the insertion member.

In one embodiment of the invention, an operating oil is filled in the receiving cylinder. In this case, it is of course required to seal for preventing the oil from flowing out of the receiving cylinder.

In a further embodiment of the invention, the actuator comprises contraction detecting means provided on one of the closure members for detecting the contractive force in the longitudinal directions, and contraction output means for outputting signals corresponding to the contractive force on the basis of output signals from the contraction detecting means.

The contraction detecting means preferably comprises strain gauges. In this case, the one of the closure members comprises a closure member body sealingly closing the end of the tubular body, a connecting member on an outer side of the closure member body, a housing connected to the connecting member and having a diaphragm portion to which the strain gages are attached, and a screw thread member connecting the diaphragm portion to the closure member body.

The threaded shank preferably comprises screw threads for threadedly connecting the connecting member to the closure member and a shank to which the strain gauges are attached.

In this manner, the detecting means is provided on at least one of the closure members for detecting the contractive force acting on a member directly or indirectly connected, so that the actual contractive force can be directly detected regardless of the hysteresis characteristics of the tubular body and reinforcing braided structure. Moreover, this detecting means constitutes a part of the closure member, so that the detecting means does not increase the space to be occupied by the actuator and only slightly increase to weight, if any.

In a further embodiment of the invention, any one of the closure members comprises a pressure sensor for detecting pressure of the pressurized fluid in the inner cavity of the tubular body.

For this purpose, one of the closure members comprises a nipple sealingly closing the end of the tubular body and a closure member body threadedly connected to the nipple on an outer side of the nipple, and at least one of the nipple and the closure member body being formed with a back pressure chamber communicating with the atmosphere and with said inner cavity, and there is provided a support separating the back pressure chamber into two parts respectively communicating with the atmosphere and the inner cavity and having a sensor attached to the support for producing signals in response to deformations of the support due to pressure difference between the atmosphere and the inner cavity.

As an alternative, one of the closure members is formed with a back pressure chamber in the form of a blind hole substantially axially extending from the side of the inner cavity toward axially outwardly and communicating with the atmosphere and is provided with a thin plate closing said blind hole on the side of the inner cavity and having a sensor attached to the thin plate for producing signals in response to deformations of the thin plate due to pressure difference between the inner cavity and the atmosphere.

With this arrangement, the pressure in the inner cavity of the tubular element can be exactly detected, so that the actuator can be more exactly controlled.

The invention will be more fully understood by referring to the following detailed specification and claims taken in connection with the appended drawings.

DESCRIPTION OF THE PREFERRED EMBODIMENTS

Figure 1:
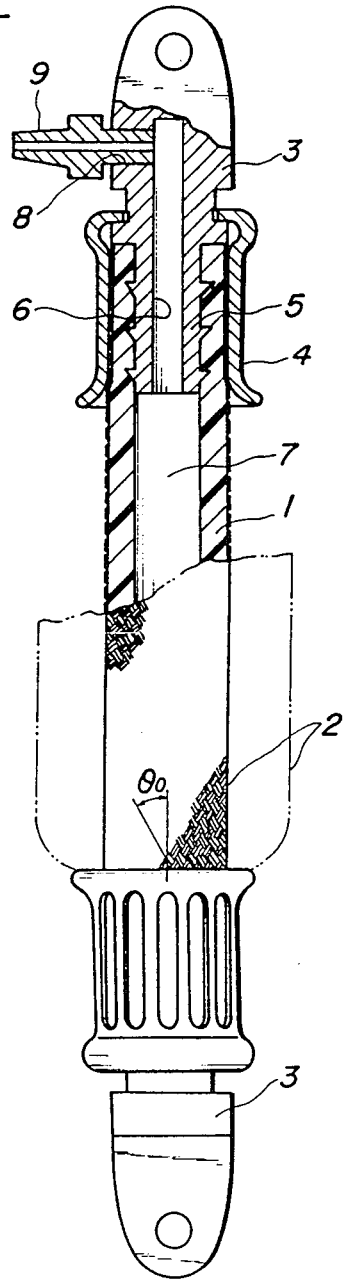
FIG. 1 PRIOR ART
FIG. 1 is a partial sectional front view of a pneumatic actuator of the prior art.
Figure 2A:
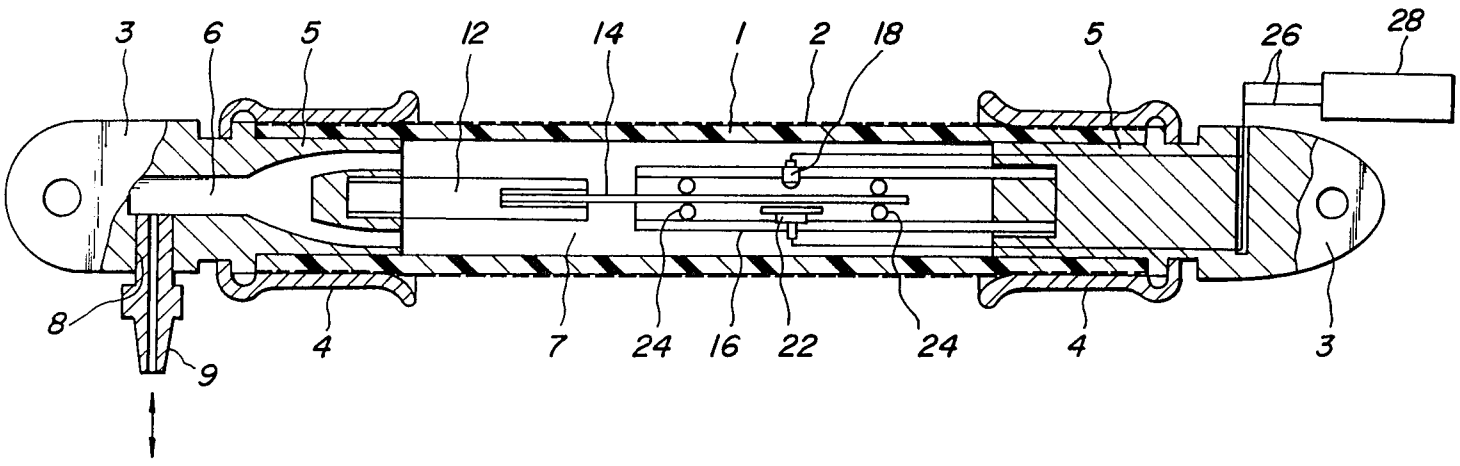
FIG. 2*a* is a partial sectional front view of a pneumatic actuator according to the invention.

Referring to FIG. 2*a* illustrates partially in section a pneumatic actuator according to the invention comprising a tubular body 1 made of a rubber or a rubber-like elastic material, a braided structure 2 made of a high tensile strength fibers reinforcing an outside of the tubular body 1 and closure members 3 sealingly closing ends of the tubular body in the same manner as that of the prior art. Moreover, the tubular body 1 and the reinforcing braided structure 2 are more securely clamped together by clamp sleeves 4 cooperating with nipples 5 of the closure members 3. A pressurized fluid is supplied into an inner cavity 7 in the tubular body 1 through a fitting 9 fitted in a connecting aperture 8 formed in one of the closure members.

Figure 2B:
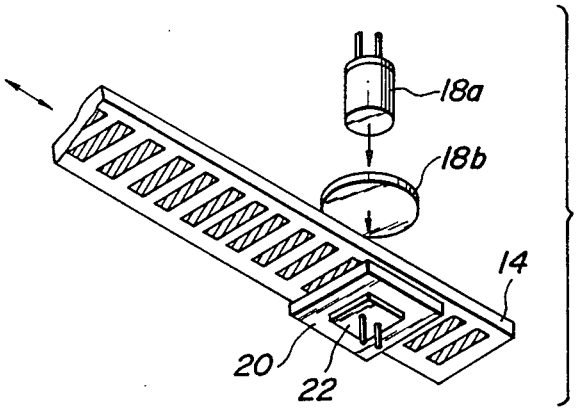
FIG. 2*b* is a perspective view illustrating detecting means used in the pneumatic actuator shown in FIG. 2*a;*

A support member 12 is fixed to an inner end of the closure member 3 having the fitting 9 by means of a conventional method such as screw threads or an adhesive. An insertion member 14 is secured to the support member 12 by means of a conventional method as screw threads or an adhesive. The insertion member 14 extending in the inner cavity 7 is formed with slit-like patterns arranged in a moving direction of the insertion member with an internal as shown in FIG. 2*b*.

On the other hand, the other closure member 3 spaced from and in opposition to the closure member 3 having the support member 12 comprises a receiving cylinder 16 fixed thereto for telescopically receiving the insertion member 14. The receiving cylinder 16 is provided with detecting means for detecting axial displacements of the insertion member 14. The detecting means comprises a light emission element 18 including a light source 18*a* and a condenser 18*b*, a detecting element 20 including at its upper and lower portions slits whose phases are 90° shifted from each other and in opposition to the insertion member 14 and a light receiving element for receiving the light emitted from the light source 18*a* and passed through the detecting element 20. Moreover, the receiving cylinder 16 comprises guiding means 24 to ensure that the insertion member 14 always maintains its substantially constant geometrical relation with respect to the detecting means.

Figure 2C:
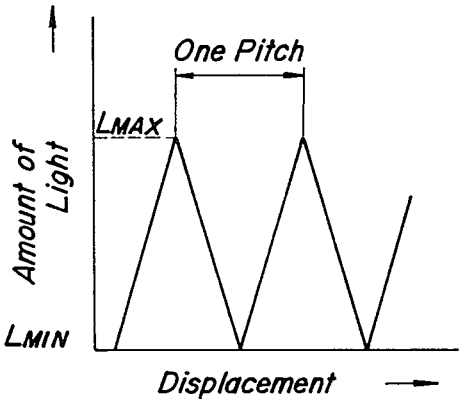
FIG. 2*c* is a diagram illustrating outputs of the detecting means shown in FIG. 2*b;*

With this arrangement of the pneumatic actuator, a pressurized fluid is introduced through the fitting 9 into the tubular body 1. As the result, the tubular body 1 expands to shorten the distance between the closure members so as to permit the insertion member to enter the receiving portion, so that the light receiving portion 22 detects the change in amount of light corresponding to positions of the respective slits of the insertion member and the detecting element. One example of the change in the detected signals is shown in FIG. 2c. The detected signal from the light receiving element 22 is transmitted through a lead wire 26 to output means 28. The output means 28 counts the number of pitches corresponding to the pitch of the slits of the insertion member and further arithmetically operates and counts values between the maximum and minimum amount of light $L_{MAX}$ and $L_{MIN}$ by interpolation to represent relative displacements between the closure members as outputs. Moreover, the output means 28 preferably comprises resetting means for zeroing the representation when the actuator is set by supplying the pressurized fluid at a determined pressure into the actuator.

In contract, when the pressurized fluid is exhausted from the inner cavity, the closure members move away from each other and the insertion member moves relative to the detecting means to the left as viewed in FIG. 2*a*. On the other hand, the output means 28 arithmetically operates to do subtraction on the basis of signals from the detecting means and represents the results as outputs. Accordingly, an operator always correctly knows the relative displacements between the closure members.

The pitch of the slits of the insertion member and the detecting element is selectively determined depending upon the accuracy of the displacements required in the actuator.

Figure 3A:
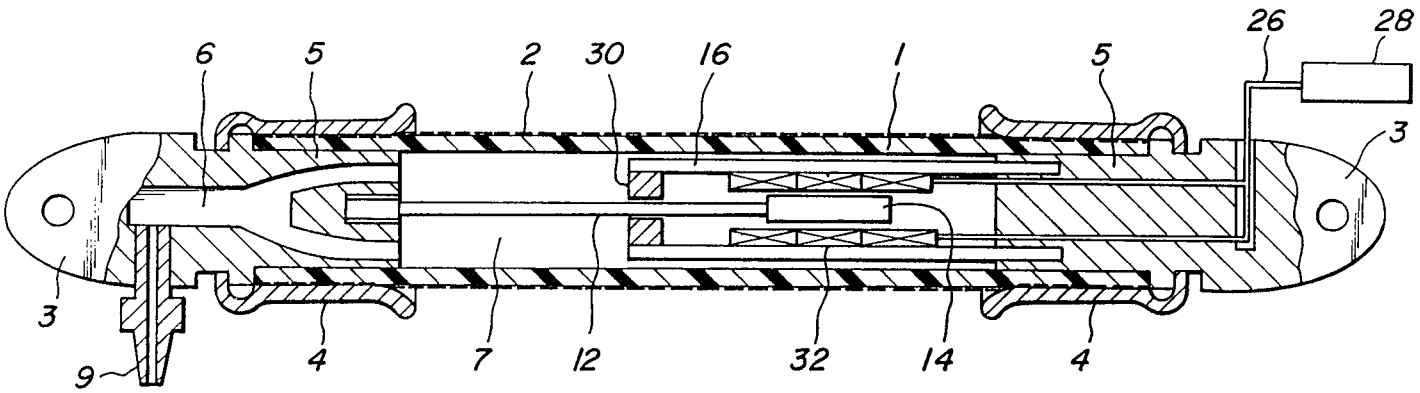
FIG. 3*a* is a partial sectional view showing another embodiment of the pneumatic actuator according to the invention.

FIG. 3*a* illustrates another embodiment of the invention, which is similar to that shown in FIG. 2*a* with exception fo detecting means and receiving cylinder 16. For the sake of simplicity, these same parts will not be described in further detail.

Figure 3B:
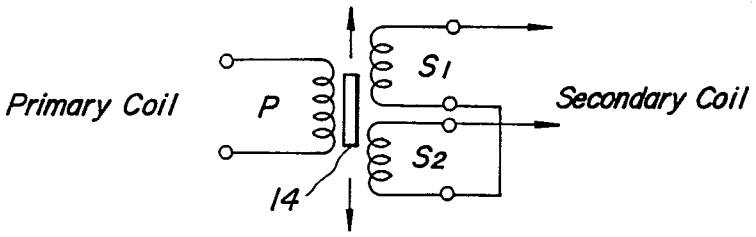
FIG. 3*b* illustrates a constitution of the detecting means shown in FIG. 3*a;*
Figure 3C:
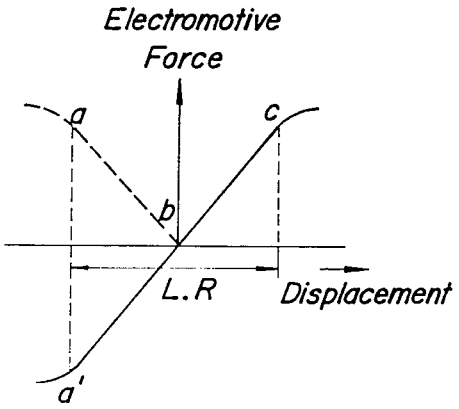
FIG. 3*c* illustrates outputs of the detecting means shown in FIG. 3*a;*

In this embodiment, an insertion member 14 secured to a support member 12 is made of a magnetic material, for example, iron. The support member 12 is slidably supported by a support wall 30 in the receiving cylinder 16. A coil 32 as detecting means is arranged spaced apart and round the insertion member 14 in the receiving cylinder 16. The support wall 30 serves as a guide for the support member 12 similarly to the guide 24 of the previous embodiment. The coil 32 comprises a primary coil P and secondary coils $S_1$ and $S_2$ to form with the insertion member 14 a so-called "differential transformer" as shown in FIG. 3*b* which produces detection signals indicated by linear lines $\overline{ab}$ and $\overline{bc}$ as shown in FIG. 3*c*. A range LR in which displacements are directly proportional to electromotive forces is used in the actual measurement.

In a differential transformer, phases are shifted 180° from a point where a member corresponding to the insertion member 14 is located at a center of the coil 32. The output means for the pneumatic actuator of this embodiment has an inverter which inverts the polarity of output signals within the range of ab. Moreover, the detected signals represent outputs in the same manner as in the embodiment shown in FIG. 2*a* by applying bias voltage such that the electromotive force at the point a' becomes apparently or in outward appearance "zero".

Figure 4:
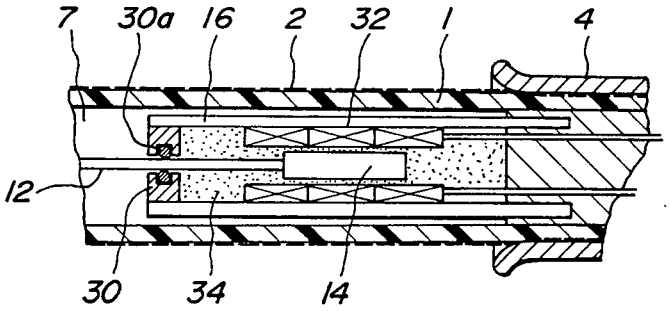
FIG. 4 is a partial sectional view illustrating a further embodiment of the pneumatic actuator according to the invention.

FIG. 4 illustrates a further embodiment of the invention. In this embodiment, although a coil 32 is used as detecting means similarly to the embodiment shown in FIG. 3*a*, a space defined by a receiving cylinder 16 and a support wall 30 is filled with an operating oil 34. In order to prevent the oil 34 from flowing into an inner cavity 7 of a tubular body 1, sealing means 30*a* is provided in the support wall 30 to seal between a support member 12 and the support wall 30. With this arrangement, the coil 32 and the insertion member 14 form an orifice therebetween, with the result that the detecting means functions as a damper. Vibrations due to the compressibility of the air and elasticity of the tubular body which are particularly acute in the above embodiments are absorbed to ensure a more smooth operation. An opening area of the orifice is selectively determined dependently upon the size, materials and pressure to be applied. In this case, a spacer may be provided between the coil 32 and the receiving cylinder or the diameter of the insertion member may be suitably changed.

Figure 5:
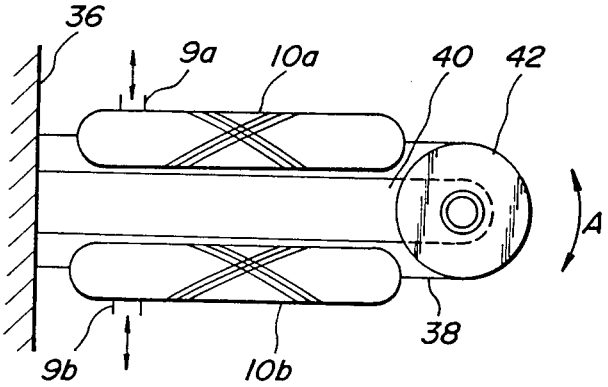
FIG. 5 is a schematic view showing driving means using the pneumatic actuators according to the invention.

In actually using such a pneumatic actuator, at least two actuators are used as a set. These actuators are suitable for an apparatus having a stationary part to which are connected respective ends of the two actuators and a drive member is connected directly or indirectly to the other ends of the actuators and moved by supplying a pressurized fluid into the actuators. One example of such a driving apparatus is shown in FIG. 5. In FIG. 5, two pneumatic actuators 10*a* and 10*b* having fittings 9*a* and 9*b* are connected to a stationary part 36. To the stationary part 36 is rotatably supported a pulley 42 as a driven member around which a wire 38 extends.

In operation of the apparatus shown in FIG. 5, the actuators are supplied with a pressurized fluid at a predetermined pressure and set under being ready for operation. Then the pressurized fluid is further supplied to one of the actuators and the pressurized fluid is exhausted from the other to rotate the pulley 42 in a direction shown by an arrow A in FIG. 5. In this case, amounts of contraction and elongation of the respective actuators are directly known by the detecting means. The wire 38 is subjected to a tensile force due to the difference in contractive force between both the actuators to cause an elongation in the wire. Judging from the elongation, the rotated angles of the pulley can be exactly determined.

When a pressurized fluid at a pressure P is supplied into the pneumatic actuator, it is known that its contractive force F is indicated by the following equation.

$$F = \frac{\pi}{4} D^2 \frac{P}{\sin^2\theta_o} \{3\cos^2\theta_o(1 - \epsilon)^2 - 1\} \quad (1)$$

D: diameter of tubular body $\theta_0$: braided angles of reinforcing braided structure $\epsilon$: contractive strains Now, since the pressure P and the contractive strains $\epsilon$ are known, the tensile load acting upon the wire 38 is immediately calculated. Accordingly, the movement of the driven member is more precisely determined by giving the output means a function which compensates for the elongation in the wire 38 on the basis of the pressure acting upon the respective actuators and the contractive strains obtained by treating detected signals from the detecting means. As an alternative, the output means may be constructed for compensating and indicating the wire elongation by directly detecting the force acting upon the wire 38.

The invention is not limited to the above embodiments and various modifications and variations are possible without departing from the spirit and scope of the invention. For example, in order to obtain a servo-system superior in responsibility, a closed loop may be formed which comprises control means for controlling the supply of the pressurized fluid into and exhaust from the pneumatic actuator correspondingly to input signals and a comparison circuit for comparing detecting signals from the detecting means with the input signals to transmit control signals to the control means so as to restrain the difference between the input and output signals in an allowable range.

As can be seen from the above description, according to the invention the detecting means is arranged in the inner cavity of the tubular body for detecting the relative displacement of the closure members sealing closing the tubular body, lengths of the actuator in its axial directions can be exactly known without considering hysteresis characteristics of the tubular body made of rubber or rubber-like elastic material and reinforcing braided structure, thereby obtaining the actuator easy to do positioning operation. Moreover, the actuator according to the invention can be provided with a damping function to eliminate the various problems due to the compressibility of the air, so that the actuator is suitable for assembling precision equipment. According to the invention, furthermore, the detecting means is arranged in the inner cavity to reduce the compressed air required to drive the actuator, thereby decreasing the running cost.

Figure 6:
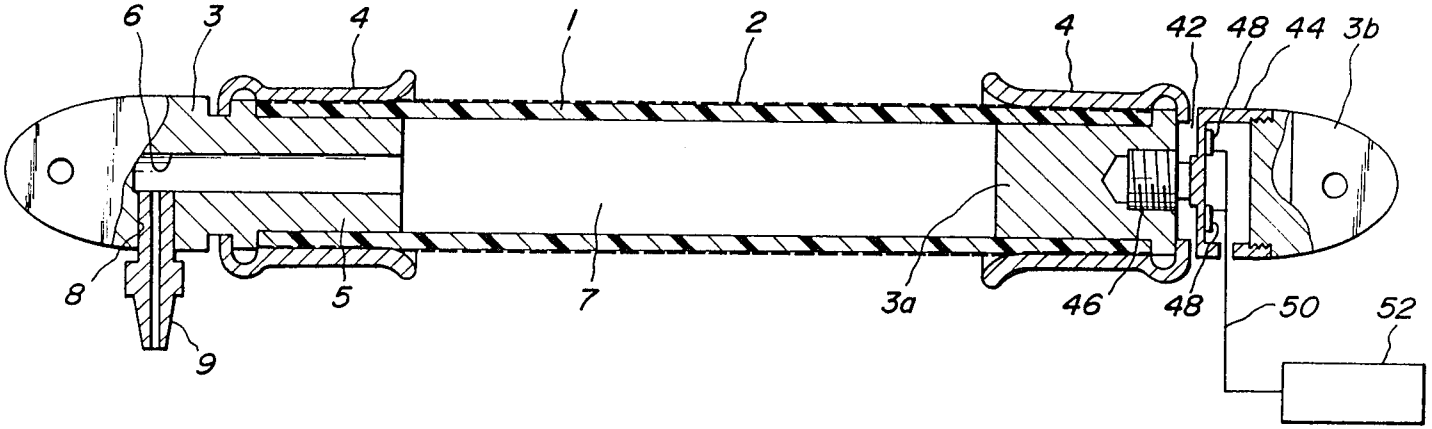
FIG. 6 is a sectional view of another embodiment of the actuator according to the invention having contraction detecting means.

FIG. 6 illustrates a further embodiment of the invention, whose closure member having no fitting 9 is quite different from those of the above embodiment. The closure member consists of a closure member body 3*a* sealing closing one end of a tubular body 1 and a connecting member 3*b* having a connecting pin aperture. To the connecting member 3*b* is connected a housing 44 having a diaphragm portion 42 facing to the closure member body 3*a*. The diaphragm portion 42 is fixed to the closure member body 3*a* by means of screw threads 46. Strain gauges 48 are attached to the diaphragm portion 42 to detect forces acting on the diaphragm in axial directions of the tubular body as change in electrical resistance. Although the strain gauges 48 may be attached to the diaphragm portion on the side of the closure member body 3*a*, it is better to attach the strain gauges 48 on the surface of the diaphragm portion in a space defined by the housing 44 and the connecting member 3*b* as shown in FIG. 6, in order to avoid direct influence of the outer atmosphere. A thickness and a shape of the diaphragm 12 may be suitably selected according to magnitude of contractive forces caused by the pneumatic actuator and applications thereof. As shown in this embodiment, it is preferable to use the screw threads 46 so as to permit the connecting member 3*b* and the housing 44 having the strain gauges 48 to be detachable from the closure member body 3*a* according to used conditions of the actuator.

The change in resistance corresponding to the contractive force detected by the strain gauges 48 as detecting means is converted into electric voltage by means of a bridge circuit including the strain gages. The electric voltage as detected signal is transmitted through lead wires 50 to output means 52 which amplifies the detected signals to indicate the contractive forces of the actuator.

One end of the pneumatic actuator thus constructed is connected to a stationary part and the other end is connected to a driven member (not shown). In this manner, an operator can know exactly the axial force caused in the actuator when the pressurized fluid is introduced into or exhausted from the tubular body 1.

As an alternative, the closure member body 3*a* may be formed with a recess in which the housing 44 is fixed, and the housing 44 is connected to the connecting member 3*b* with the aid of the screw threads 46.

Figure 7A:
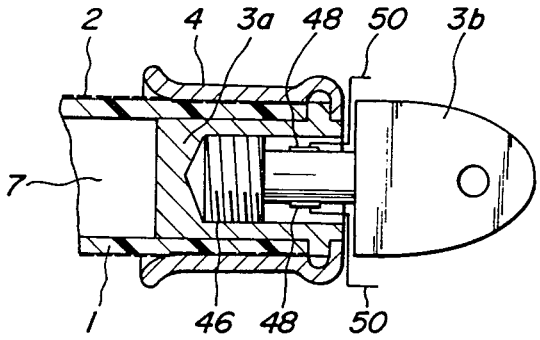
FIG. 7*a* is a partial sectional view of a further embodiment of the actuator according to the invention.

FIG. 7*a* illustrates a further embodiment of the pneumatic actuator according to the invention, which shows only the parts associated with detecting means for the sake of the clarity.

Figure 7B:
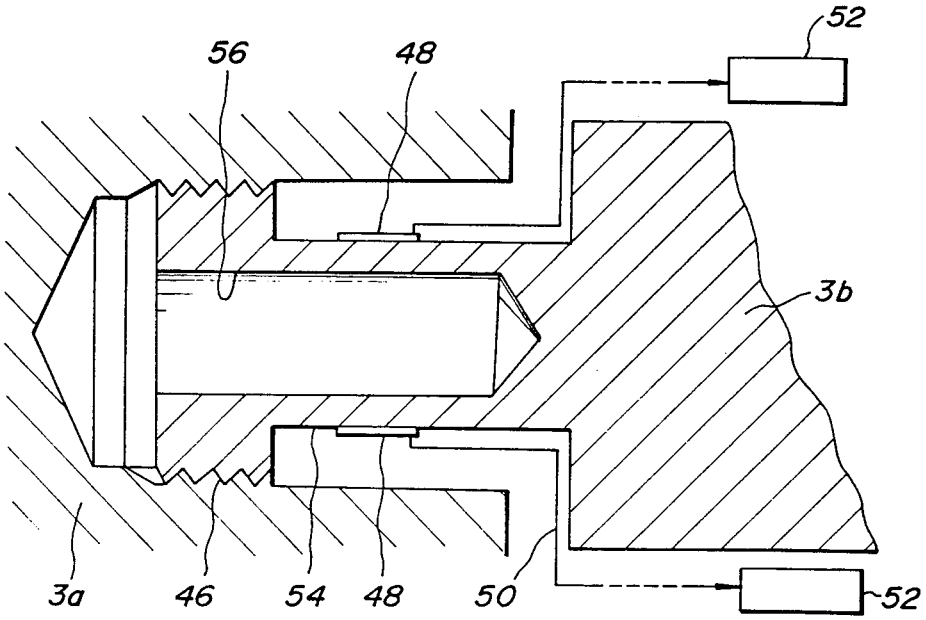
FIG. 7*b* is an enlarged sectional view of the actuator shown in FIG. 7*a;*

Although this embodiment is similar to the embodiment whose connecting member 3*b* is connected to the closure member body 3*a* by means of set screws 46 as shown in FIG. 6, strain gauges 48 are attached to a neck or shank 54 of the screw threads 46 (FIG. 7*b*) to detect the axial force instead of attaching the strain gages to the diaphragm portion of the housing. This arrangement does not need the housing 44 and at the same time facilitates the attaching of the strain gauges to lower the cost. As shown in FIG. 7*b*, the screw threaded portion is formed with a blind hole 56 opening toward the closure member body 3*a* to increase the strain occurring in the neck 54, thereby enabling a relatively slight contractive force to be measured.

Figure 8:
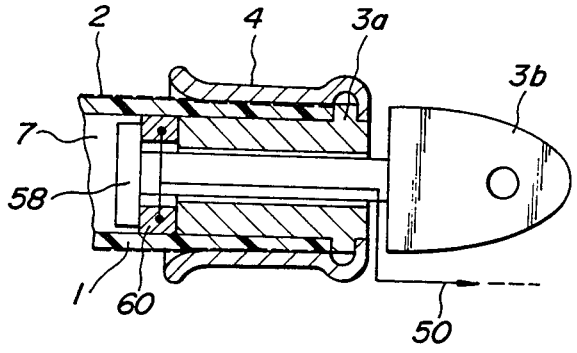
FIG. 8 is a sectional view of another embodiment of the invention.
Figure 9:
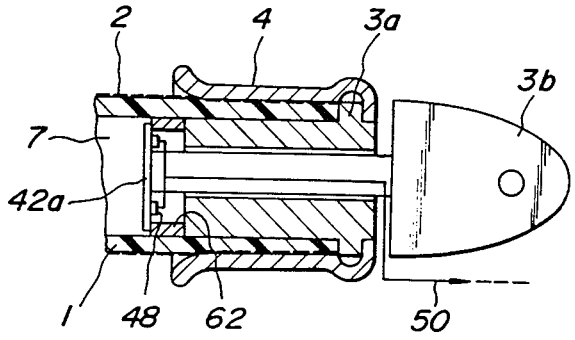
FIG. 9 is a sectional view of a further embodiment of the invention.

FIGS. 8 and 9 show other embodiments of the invention. In FIG. 8, although a closure member body 3*a* and a connecting member 3*b* form a closure member in the same manner as in FIG. 6 and FIG. 7*a*, the connecting member 3*b* comprises a rod (having no reference numeral) sealingly slidable in the closure member body 3*a* and an anchoring plate 58 supported by the rod. A piezo-electric element 60 as a detecting element in the form of a ring is arranged between the anchoring plate 58 and an end surface of the closure member body 3*a* on the side of an inner cavity 7 of the tubular body 1. Complete sealing is applied between the anchoring plate 58 and the piezo-electric element 60 and between the closure member body 3*a* and the piezo-electric element 60 in order to prevent the pressurized fluid in the inner cavity of the tubular body from leaking through clearances between the anchoring plate, the piezo-electric element and the closure member body. However, sealing may be effected only between the slidable rod and the closure member body. On the other hand, contacting surfaces of the piezo-electric element 60 and the tubular body 1 are not sealed in order to avoid any influence of the expansion of the tubular body on the piezo-electric element.

With the actuator thus constructed, when the pressurized fluid is applied, the closure member body 3*a* and the connecting member 3*b* move away from each other, so that the piezo-electric element 60 between the closure member body 3*a* and the anchoring plate 58 is subjected to compressive force to produce detected signals proportional to the compressive force i.e. the contractive force caused in the actuator. The detected signals are transmitted through a lead wire 50 to output means similarly to the embodiment shown in FIG. 6.

In FIG. 9, a connecting member 3*b* comprises a rod (having no reference numeral) sealingly slidable in a closure member body 3*a* and a diaphragm 42*a* which is supported by the rod and located spaced from the closure member body 3*a* through a collar 62. Strain gauges 48 are attached to the diaphragm 42*a* to produce detected signals proportional to the contractive force occurring in the actuator. The operation of the actuator of this embodiment will not be described in further detail since the operation is substantially identical with that of the actuator shown in FIG. 6.

When the connecting member of the actuator is connected to a driven member through, for example, a wire, the contractive distance of the actuator can be obtained from the above equation (1), if the elongation of the wire is negligible. By inputting into the output means the pressure to be applied and the function for computing the equation (1), the operator can know the acting force and the displacement. Accordingly, the actuator can be used for assembling apparatuses for precision equipment.

As can be seen from the above description, the pneumatic actuator according to the invention comprises detecting means provided on one of the closure members for producing signals corresponding to axial contractive forces and output means for outputting signals corresponding to the contractive forces on the basis of the detected signals from the detecting means. The pneumatic actuator is therefore easy to control without spoiling the merit of the air-bag type actuator of light weight and low cost and without requiring any separate device for measuring the contractive forces as in the prior art. Moreover, since the member having the detecting means and the closure member body connected thereto are made detachable to facilitate the exchange of the detecting means according to applications, thereby making the actuator easier to use. Particularly, the detecting means is formed integrally with the closure member of the actuator to make the actuator compact without increasing the space to be occupied by it.

Figure 10:
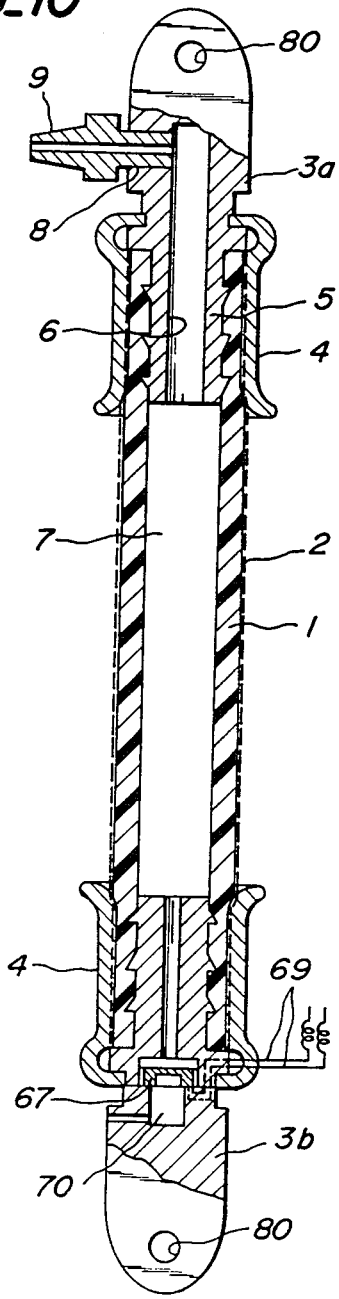
FIG. 10 is a front view, in partial section, of one embodiment of the pneumatic actuator having the pressure sensor for directly detecting the pressure in the inner cavity of the tubular body.
Figure 11:
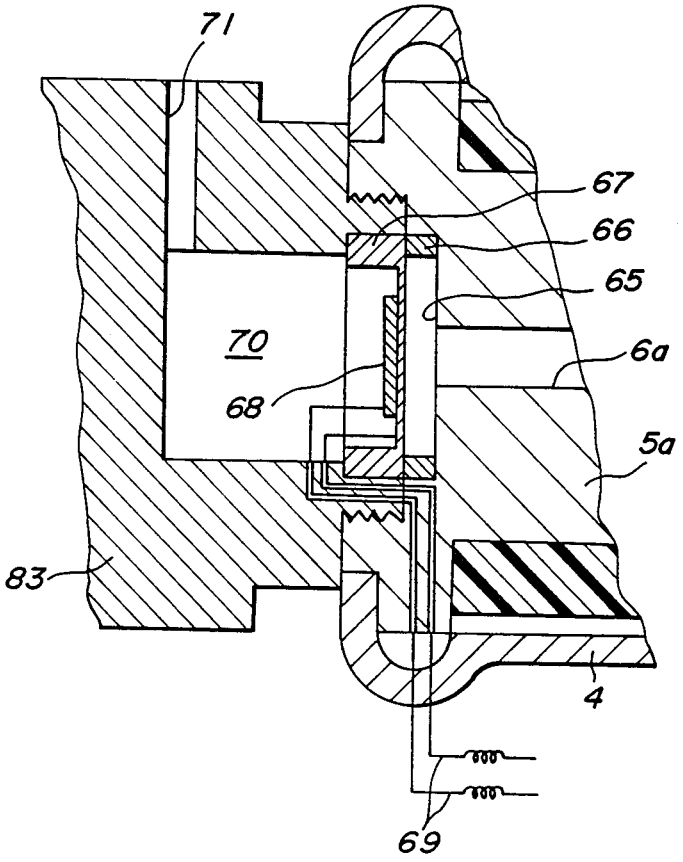
FIG. 11 is an enlarged sectional view of part of the actuator shown in FIG. 10.

FIG. 10 illustrates a further embodiment of the invention, wherein a pressure sensor is provided in an inner cavity of a tubular body for detecting the pressure therein. FIG. 11 shows a closure member sealingly closing one end of a tubular body on the enlarged scale. The closure member comprises a nipple 5 and a closure member body 83 threadedly engaging the nipple 5. The nipple 5 has a recess 65 located on one end remote from an inner cavity 7 of the tubular body 1 and communicating with the inner cavity 7 through a communicating passage 6*a*. A spacer 66 is arranged in the recess 65. On the other hand, the closure member body 83 is formed in one end remote from a pin aperture 10 (FIG. 10) with a back pressure chamber 70 in opposition to the recess 65. The back pressure chamber 70 communicates the atmosphere through a communicating aperture 71 and partially receiving a pressure sensor.

The pressure sensor comprises a support 67 located adjacent to a spacer 66, a piezo-electric ceramic element 68 and lead wires 69 for transmitting detected signals produced by the element 68 to an outer device. The support 67 cooperates with the spacer 66 to maintain the inner cavity 7 in air-tight condition.

With this pneumatic actuator thus constructed, when the pressurized fluid is introduced into the actuator, the pressure sensor immediately detects the pressure difference between the inner cavity 7 of the tubular body and the back pressure chamber 70 communicating with the atmosphere through the communicating aperture 71.

Figure 12:
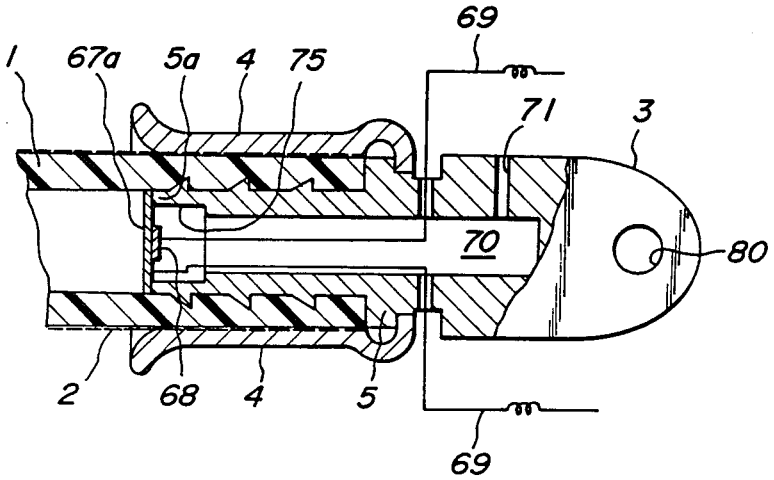
FIG. 12 is a further embodiment of the actuator according to the invention.

FIG. 12 illustrates further embodiment of the invention, wherein a closure member is provided on an end near to an inner cavity with a support for supporting a piezo-electric ceramic element 68, without threadedly connecting the closure member body and the nipple as in the embodiment shown in FIGS. 10 and 11. Namely, the nipple 5 is formed in its end 5*a* with a recess 75 to form a back pressure chamber 70. The recess 75 communicates with the atmosphere through a communicating aperture 71. To the end 5*a* of the nipple 5 is attached a thin plate 67*a* in an air-tight manner by means of, for example, an adhesive. On a surface of the thin plate 67*a* on the back pressure chamber side is attached a piezo-electric ceramic element 68 for outputting detecting signals corresponding to the pressure difference between the back pressure chamber 70 and the inner cavity 7.

With this arrangement according to the embodiment, since the nipple 5 and the closure member body 33 do not need to be separately formed, the closure member can be easily worked to lower the cost of the actuator.

Any sensors may be used in these embodiments other than the piezo-electric ceramic element, such as semiconductur pressure sensor, electrostatic capacity pressure sensor for detecting the change in distance between stationary and movable electrodes, strain gage pressure sensor for detecting strains of diaphragm or the like. These sensors may be provided on the closure member on the inlet side of the pressurized fluid or on the closure member in a direction intersecting the axial direction of the tubular body.

As can be seen from the above description, according to the last embodiments a pressure sensor is provided on at least one of the closure members sealingly closing ends of the tubular body of the rubber-like elastic material to eliminate a separate pressure detecting means in the line for introducing the pressurized fluid into the actuator, thereby eliminating leakage of the pressurized fluid between the pressure detecting means and the line, and further facilitating the piping and compacting the pneumatic actuator itself. As the pressure is directly detected in the inner cavity of the tubular body, the pressure of the fluid can be exactly controlled and any extraordinary condition of the tubular body, particularly leakage of the fluid from the tubular body due to fatigue or damage can be easily detected.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A pneumatic actuator comprising: a tubular body made of a rubber-like elastic material, a braided structure made of organic or inorganic high tensile strength fibers reinforcing an outside of said tubular body and closure members sealingly closing ends of said tubular body, at least one of said closure members having a connecting passage, said tubular body being deformed to expand its diameter by introducing pressurized fluid thereinto through said connecting passage to cause a contractive force in its longitudinal direction, said actuator comprising contraction detecting means having strain gauges, said contraction detecting means provided at one of said closure members for detecting said contractive force in the longitudinal direction, and contraction output means for outputting signals corresponding to the contractive force on the basis of output signals from said contraction detecting means, and wherein said one of the closure members comprises, a closure member body sealingly closing the end of the tubular body, a connecting member on an outer side of the closure member body, a housing connected to said connecting member and having a diaphragm portion to which said strain gages are attached, and a screw thread member connecting said diaphragm portion to said closure member body.

2. A pneumatic actuator comprising: a tubular body made of a rubber-like elastic material, a braided structure made of organic and inorganic high tensile strength fibers reinforcing an outside of said tubular body and closure members sealingly closing ends of said tubular body, at least one of said closure members having a connecting passage, said tubular body being deformed to expand its diameter by introducing pressurized fluid thereinto through said connecting passage to cause a contractive force in its longitudinal direction, said actuator comprising contraction detecting means having strain gauges, said contraction detecting means provided at one of said closure members for detecting said contractive force in the longitudinal direction, and contraction output means for outputting signals corresponding to the contractive force on the basis of output signals from said contraction detecting means, and wherein said one of the closure members comprises a closure member body sealingly closing the end of the tubular body, and a connecting member arranged on an outer side of the closure member body and having a threaded shank, and said threaded shank comprises screw threads for threadedly connecting the connecting member to said closure member and a shank to which said strain gages are attached.

3. A pneumatic actuator as set forth in claim 2, wherein a blind hole is formed in said threaded shank to increase deformation of said shank.

* * * * *